US006850204B1

(12) United States Patent
Angelucci

(10) Patent No.: US 6,850,204 B1
(45) Date of Patent: Feb. 1, 2005

(54) CLIP FOR RADAR ARRAY, AND ARRAY INCLUDING THE CLIP

(75) Inventor: Marc Thomas Angelucci, Cherry Hill, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 258 days.

(21) Appl. No.: 10/290,740

(22) Filed: Nov. 7, 2002

(51) Int. Cl.[7] ..... H01Q 13/10
(52) U.S. Cl. ..... 343/770; 343/795; 439/916
(58) Field of Search ..... 343/770, 795, 343/700 MS, 824; 439/916, 65

(56) References Cited

U.S. PATENT DOCUMENTS 5,023,623 A * 6/1991 Kreinheder et al. ..... 343/770
5,175,560 A * 12/1992 Lucas et al. ..... 343/770
5,461,392 A * 10/1995 Mott et al. ..... 343/767
5,557,291 A * 9/1996 Chu et al. ..... 343/770
5,845,391 A * 12/1998 Bellus et al. ..... 343/770

* cited by examiner

*Primary Examiner*—Don Wong
*Assistant Examiner*—Ephrem Alemu
(74) *Attorney, Agent, or Firm*—Duane Morris LLP

(57) ABSTRACT

A radar assembly comprises a ground plane, a plurality of clips inserted into the ground plane, and a plurality of strips. At least one first strip is provided on a first subset of the clips. The first strip has a plurality of radiating elements and a first plurality of slots. At least one second strip is provided on a second subset of the clips and on the at least one first strip. The second strip has a plurality of radiating elements and a second plurality of slots that mate with the slots of the at least one first strip.

18 Claims, 15 Drawing Sheets

CLIP FOR RADAR ARRAY, AND ARRAY INCLUDING THE CLIP

FIELD OF THE INVENTION

The present invention relates to the field of microwave antenna arrays.

BACKGROUND

As the frequency of operation of radar antennas increases, the spacing between the radiating elements that make up the aperture becomes smaller. For example, the spacing may be less than 1.0 cm (0.400") center-to-center at 16 GHz (Ku band). In addition, effective phased array radars can have 10,000 or more radiating elements. The radiating elements in these assemblies have critical alignment requirements. They also require isolation between adjacent radiating elements and excellent grounding.

Previous processes formed the mechanical attachment between adjacent radiating elements in a phased array aperture with epoxy joints and machined features in soft-substrates such as "Duroid®". Materials such as polytetrafluoroethylene (PTFE) and "Duroid®" (PTFE/glass or PTFE/ceramic composites) exhibit poor dimensional stability, cold flow characteristics, and deformation under cutting stresses. Unlike metals, features machined in these materials cannot be relied upon to provide the positional alignment required in a high/wide band phased array aperture. Therefore to achieve element-to-element alignment and orientation, radiating elements were assembled using complicated tooling that required tedious fabrication procedures.

For example, a "rake" tool and a joe block were used to position and align individual radiating elements in an array, with each element on a respective substrate. The rake was used to establish a predetermined spacing between cells in the array, and the individual substrates were then positioned around the joe block to establish the correct orientation and location of the substrates. The array was built up by adding individual radiating elements. In the case of stripline circuit elements assembled in this manner, plated through-holes (vias) were used for isolation between adjacent radiating elements. This type of assembly can also have spurious grounds due to uneven or decaying epoxy joints.

An improved array structure and method of making the array is desired.

SUMMARY OF THE INVENTION

A clip for assembling a lattice of circuit boards comprises an elongated shaft having first and second ends. A base is connected to the shaft and shaped to be inserted into a ground plane at the first end of the shaft. A plurality of longitudinal grooves are provided along respective sides of the shaft. Each groove is shaped to receive a respective edge of a circuit board. At least two slots extend inward from the second end of the shaft. Each slot penetrates through the center of the shaft. Each slot is shaped to receive a connecting strip of a respective circuit board.

A radar assembly comprises a ground plane, a plurality of clips inserted into the ground plane, and a plurality of strips. At least one first strip is provided on a first subset of the clips. The first strip has a plurality of radiating elements and a first plurality of slots. At least one second strip is provided on a second subset of the clips and on the at least one first strip. The second strip has a plurality of radiating elements and a second plurality of slots that mate with the slots of the at least one first strip.

DETAILED DESCRIPTION

Figure 1:
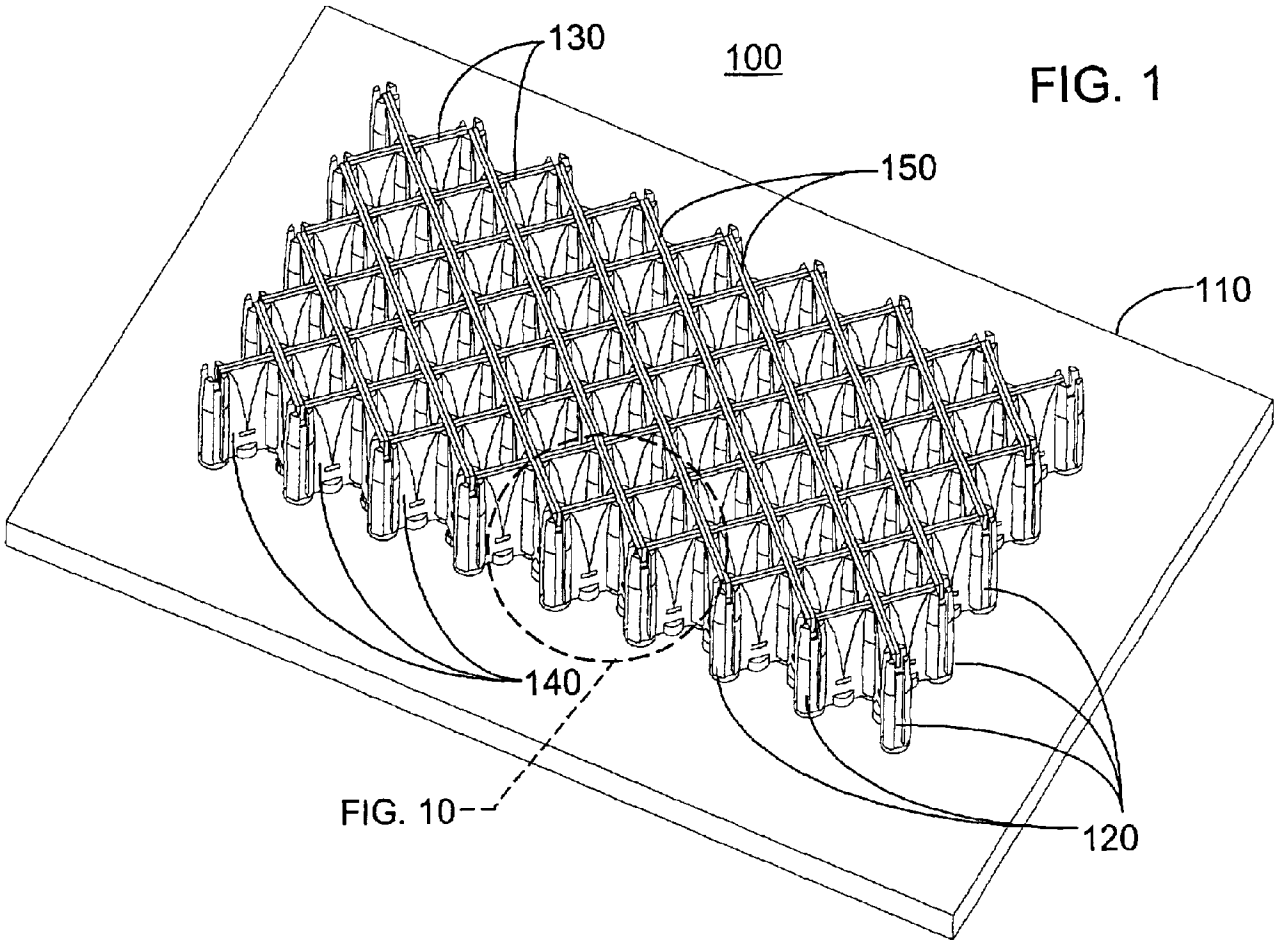
FIG. 1 is an isometric view of an exemplary microwave antenna array 100.

In the accompanying drawings, like items are indicated by like reference numerals.

This description of the preferred embodiments is intended to be read in connection with the accompanying drawings, which are to be considered part of the entire written description of this invention. In the description, relative terms such as "lower," "upper," "horizontal," "vertical,", "above," "below," "up," "down," "top" and "bottom" as well as derivative thereof (e.g., "horizontally," "downwardly," "upwardly,"etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

FIG. 1 is an isometric view of an exemplary microwave antenna array assembly 100. Array 100 may be a complete aperture or a fractional portion of a larger array suitable for use in a wide-band phased array radar system. In the exemplary array 100, radiating elements are assembled vertically above a metal ground plane in a lattice of orthogonal pairs. The structure visually resembles an "eggcrate" as shown in FIG. 1. This representative section of a large phased array aperture has 128 radiating element apertures 134, 154 on a metal groundplane 110).

The fractional radar array assembly, 100 comprises a ground plane 110, a plurality of clips 120 inserted into the ground plane 110, and a plurality of multi-element strips. The ground plane 110 may be a plate of suitable metal, such as aluminum or copper. The multi-element strips include at least one first (lower) strip 130 on a first subset of the clips 120, the first strip 130 having a plurality of radiating elements 134 and a first plurality of slots 137, 138. The multi-element strips include at least one second strip 150 on a second subset of the clips 120 and on the at least one first strip 130. The second strip 150 has a plurality of radiating elements 154 and a second plurality of slots 157 that mate with the slots 138 of the at least one first strip 130. In the example of FIG. 1, there are a plurality of lower multi-element strips 130 and a plurality of upper multi-element strips 150 arranged in a lattice array.

The exemplary array assembly 100 includes a fastener in the form of a clip 120 that assembles soft-substrate radiating element strips 130 and 150 together (on a phased array aperture groundplane 110), with a reflow solder joint. The exemplary configuration of clips 120 and radiating element strips 130, 150 is self aligning, provides excellent ground, and provides shielding between adjacent radiating elements.

FIGS. 2A–2E show an exemplary clip 120 that may be used in the assembly 100 for assembling a lattice of circuit boards. The clip 120 has an elongated shaft 121 having a first end 121*a* and a second end 121*b*. A base 122 is connected to the shaft 121 at the first end 121*a* of the shaft. In some embodiments (not shown), the top 122*t* of the base 122 extends all the way to the bottom 121*a* of the shaft. The base 122 is shaped to be inserted into the ground plane 110. A plurality of longitudinal grooves 123 are provided along respective sides of the shaft 121. Each groove 123 is shaped to closely receive a respective edge of a circuit board 130 or 150. The shaft 121 has at least two receiving slots 124 and 125 extending inward from the second end 121*b* of the shaft. Each receiving slot 124 and 125 penetrates through the center of the shaft 121. Slot 124 is shaped to receive a connecting strip (attachment portion) 132*c* of a respective circuit board 130. Slot 125 is shaped to receive a connecting strip or bridge (attachment portion) 152*b* of a respective circuit board 150. The grooves 123–125, tabs 129 and various features provide solder surfaces for forming mechanical and electrical connections to the metal ground surfaces 133, 153 of the substrates 132, 152, and allow insertion of the substrates orthogonally into the clips 120.

In some embodiments, the shaft 121 has a solid core 127 extending from the base 122 to the bottom ends of the slots 124. This solid metal core 127 prevents microwaves from jumping across between adjacent radiating elements. In the example, the slots 124 are deeper than a the slots 125, and a pair of tabs 129 extend from the solid core 127 to the bottom ends of the slots 125. Each tab 129 is positioned between one of the grooves 123 and one of the slots 124. In other embodiments (not shown), the tab 129 is omitted, and both grooves 124 and 125 are extended all the way from the top end 121*b* of the shaft 121 to the top of the core 127.

Preferably, the grooves 123 have flat side walls 123*s* that are continuous with side walls of the slots 124, and 125. This allows a solder or conductive adhesive joint to run the full length of the side walls 123*s*, including the sides of the slots 124 and 125. Alternatively, it is possible for the side surface 123*s* of the grooves 123 to have features (e.g., ridges, grooves, pits or the like, not shown), so that the contact surface between the clip 120 and the circuit boards 130, 150 is not a completely flat surface.

Figure 5:
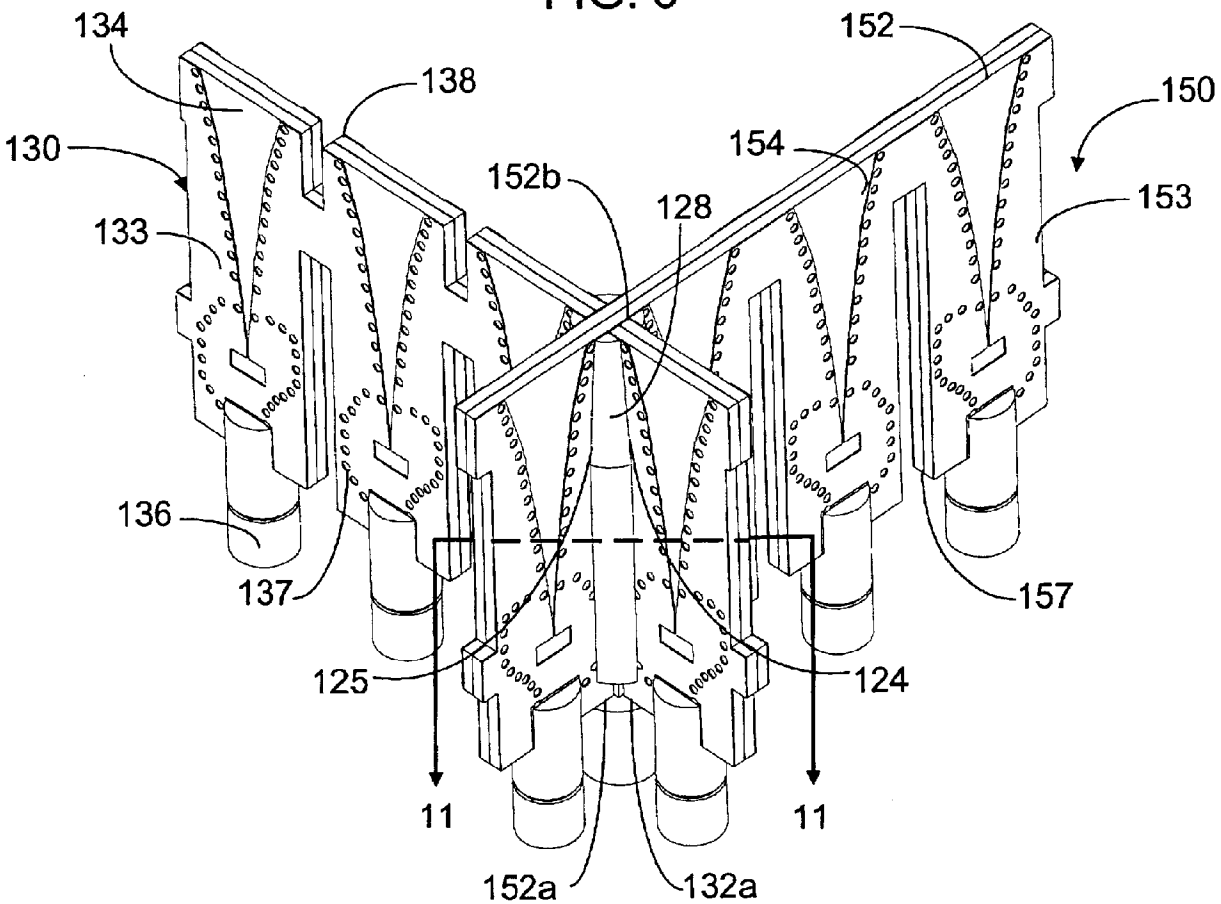
FIG. 5 is an isometric view of the partial assembly of FIG. 4 after both lower and upper multi-element strips are in position.
Figure 10:
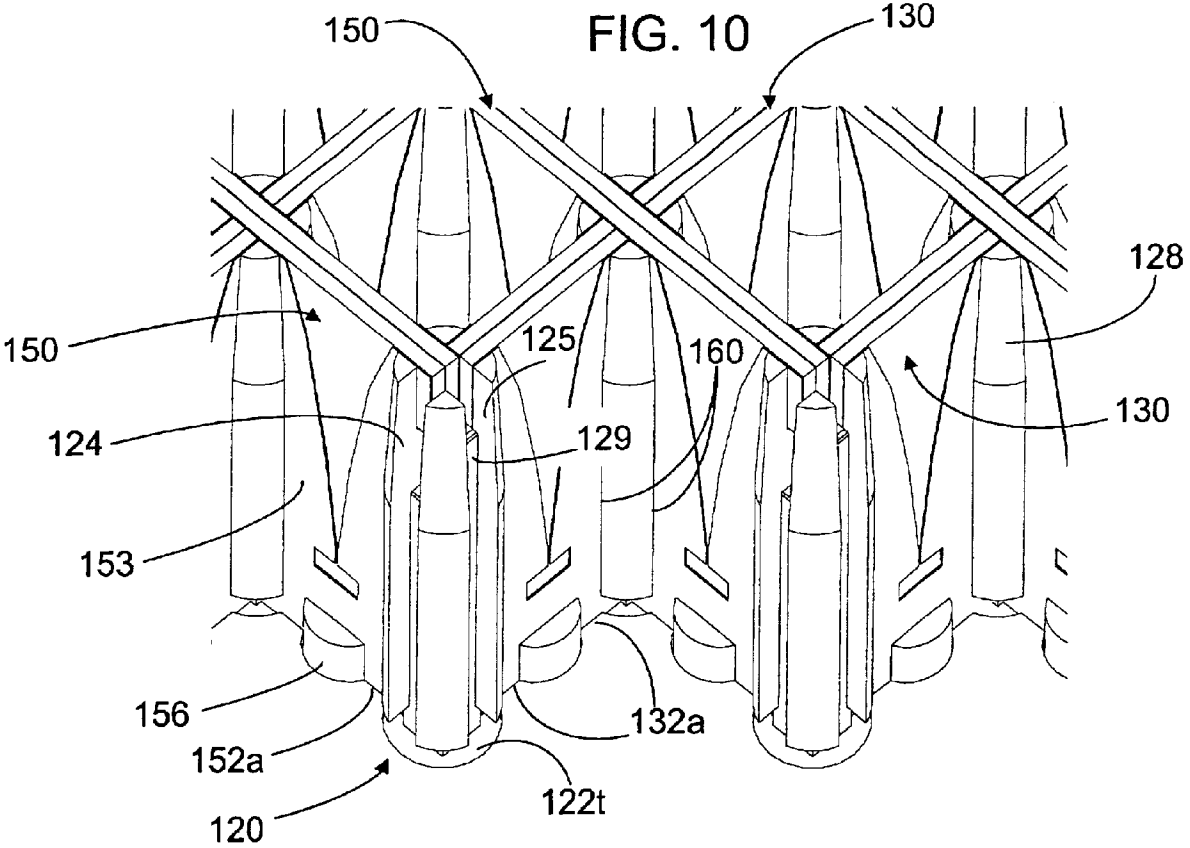
FIG. 10 is an enlarged detail of FIG. 1.

In some embodiments, the second end 128 of the shaft 121 is tapered. As best seen in FIGS. 5 and 10, the taper 128 allows the horns 134, 154 to extend close to the central axis of the clip 120 without the outer perimeter of the shaft 121 crossing the edge of the horn. In compact configurations such as shown in FIGS. 5 and 10, without the taper, the outer perimeter of shaft 121 would cross the edge of the horn 134, 154 at the top end 121*b* of the shaft. The taper 128, if present, may optionally extend approximately to a base of the slots 124. The taper 128 may be shorter or longer, so long as the shaft 121 does not cross the edge of the horn 134, 154.

Figure 2A:
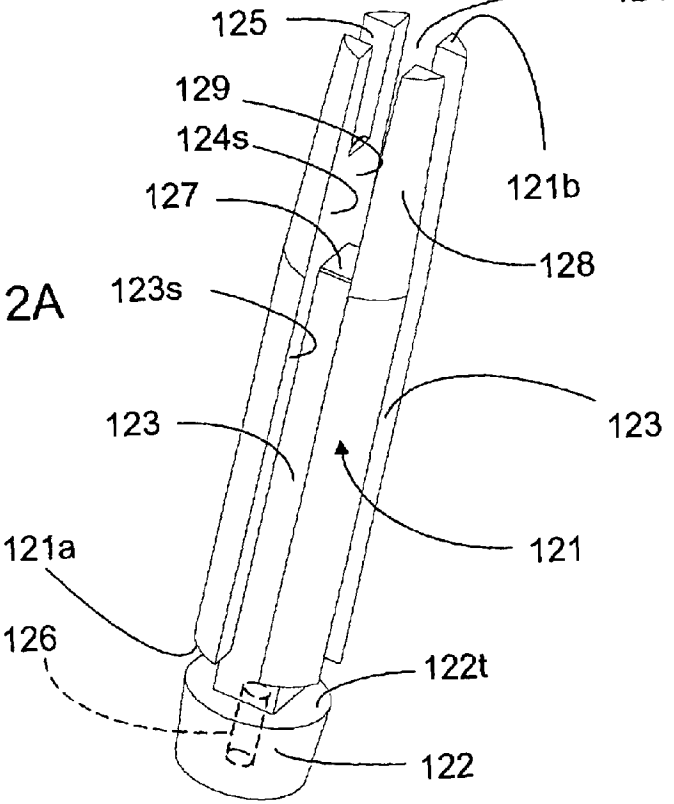
FIG. 2A is an isometric view of one of the clips shown in FIG. 1.
Figure 2E:
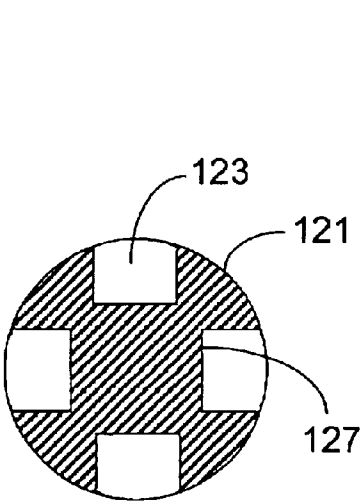
FIGS. 2D and 2E are cross sectional views taken along respective section lines 2D—2D and 2E—2E of FIG. 2B.
Figure 2D:
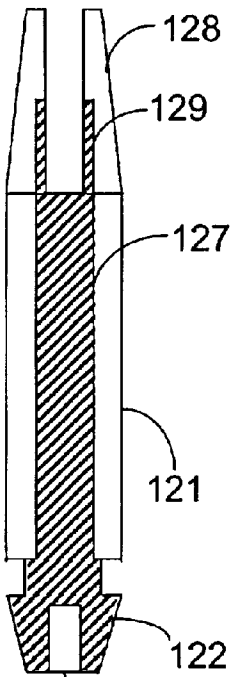
Figure 2C:
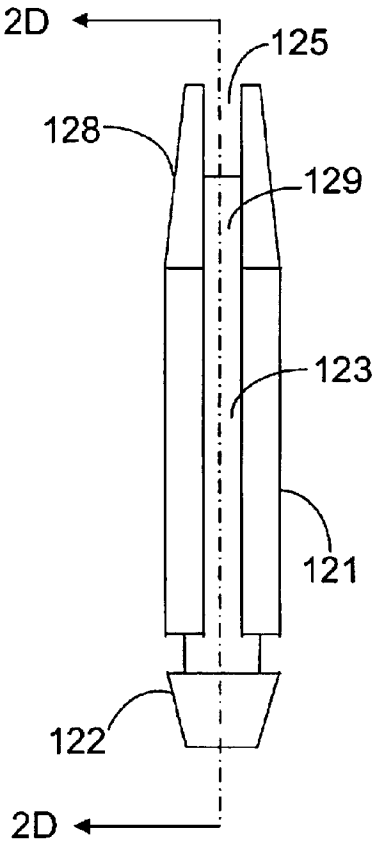
FIGS. 2B and 2C are front and side elevation views of the clip of FIG. 2A.
Figure 2B:
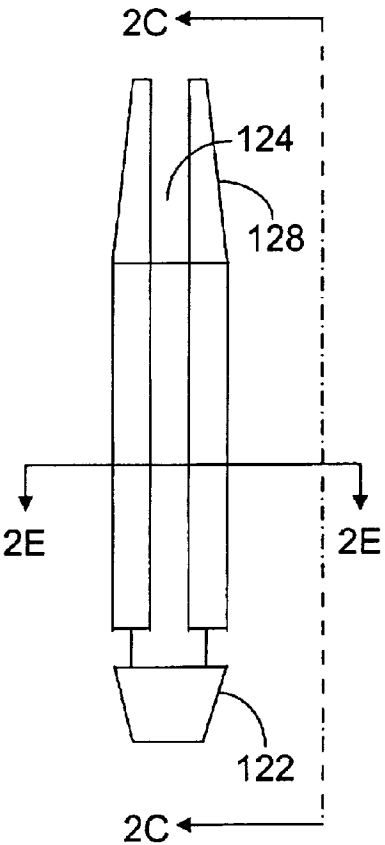

In some embodiments, the base 122 is tapered, as shown in FIGS. 2B–2D. The tapered base 122 is advantageous in that it makes the base self-centering within the plate 110 even if there is an imperfection in the hole into which the base fits. For high frequency applications, it is desirable to locate the central axis of the clip 120 within 0.05 to 0.1 millimeters (0.002 to 0.004 inches) of the center of the hole. The self-centering taper can accomplish this result. The tapered base minimizes positional variance in the assembly process. The taper is not required, and the base may be cylindrical in other embodiments.

In some embodiments, the base 122 has a threaded hole 126. For example, a helicoil may be inserted coaxially into a bore in the base 122. The threaded hole or helicoil allows secure attachment of the clip 120 to the plate 110. Other fastening techniques may be used. For instance, a male threaded shaft may project from the bottom of the base 122, to be secured by a nut from the bottom of the plate 110.

Preferably, the clip 120 is either made of a solderable material (e.g., copper or a chromium-copper alloy), or the clip has a solder or indium plating thereon. The fastener in this example is made of chromium-copper (C18200 alloy). Solder plating on all surfaces provides solder volume and protects the fastener from the environment. When the clips 120 and multi-element strips 130, 150 are assembled, the solder can be reflowed to form secure physical and electrical connections among the clips and strips. The solder may be tin-lead solder, for example. Other solder compositions or indium may be used. In alternative embodiments, conductive adhesive (e.g., conductive epoxy) may be used to form secure physical and electrical connections among the clips and strips. In still other embodiments, solder can be applied in situ after assembly of the clips 120 and strips 130, 150 onto the ground plane.

The fastener (clip) 120 forces a self-alignment and self-positioning of soft-substrate radiating elements vertically, laterally, and rotationally by means of the assembly process (described below) on a phased array aperture groundplane 110. The rotational alignment of the clips 120 and strips 130, 150 is provided by the multiplicity of interconnections between the clips 120 and substrates 132, 152 that must be aligned in order for the various strips 130, 150 to lie straight. The clip 120 is advantageous when used in a reflow process and provides the junction for a solder joint between radiating elements. It has a well-defined mechanical attachment to the groundplane, and hence each clip 120 forms a structural node in the assembly. It provides excellent element-to-element isolation and grounding. The exemplary clip forms a reliable mechanical solder attachment for orthogonally placed soft-substrate radiating elements in wide-band phased array radar apertures.

Figure 3:
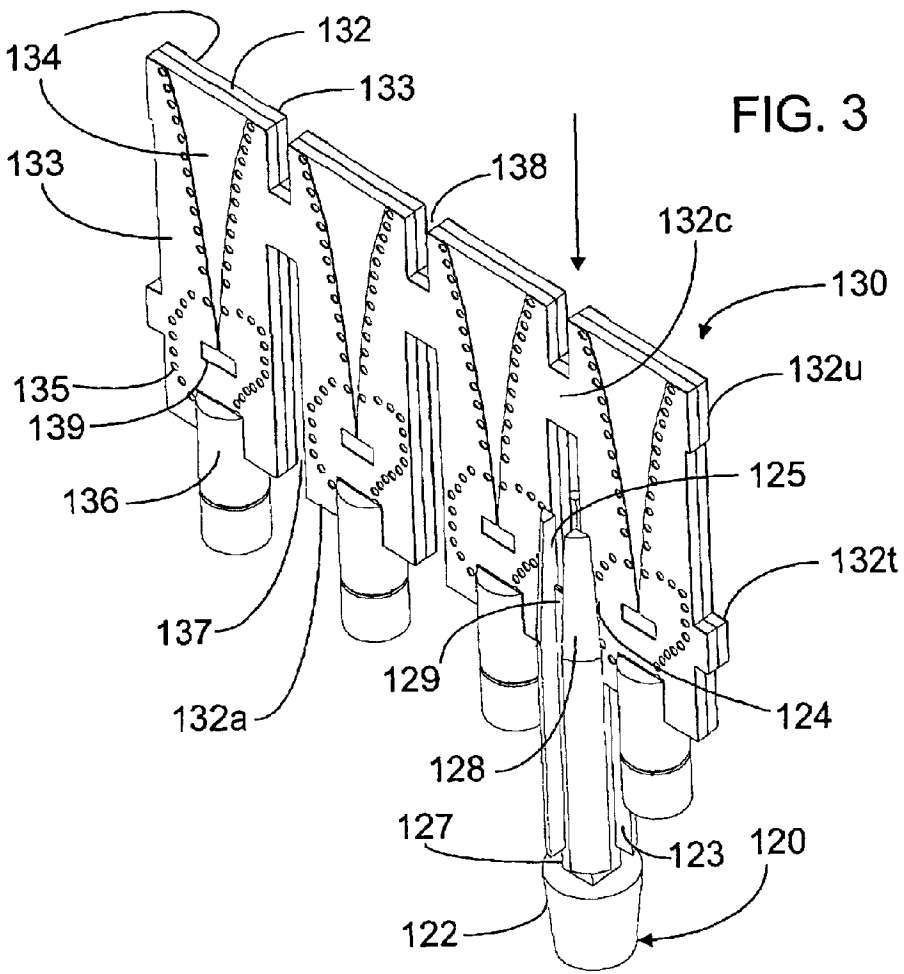
FIG. 3 is a partial assembly view showing the step of mounting of one lower multi-element strip (of the type shown in FIG. 1) on the clip of FIG. 2A.
Figure 4:
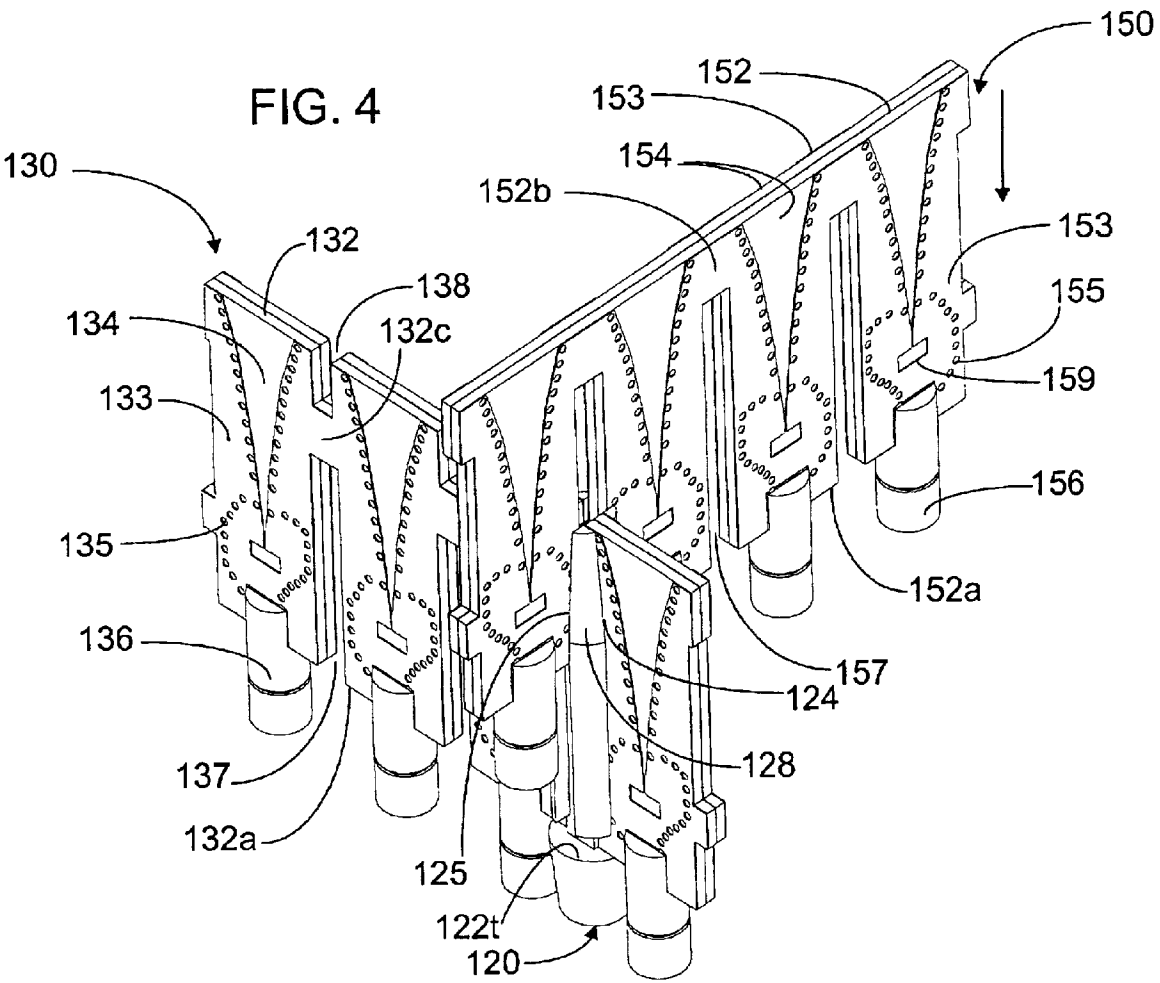
FIG. 4 is an isometric view showing the step of mounting an upper multi-element strip (of the type shown in FIG. 1) on the partial assembly of FIG. 3.

FIGS. 3–5 show a method for assembling a sub-assembly having one clip 120, one lower multi-element strip 130, and one upper multi-element strip 150.

FIG. 3 shows a single lower multi-element strip 130 being mounted to a clip 120. The multi-element strip has substrate 132, which may be made from an "RT/duroid® 6002" PTFE ceramic composition, manufactured by the Rogers Corporation of Rogers, Conn. The exemplary substrate 132 has two 0.63 mm (0.025") layers of PTFE ceramic dielectric. One of the layers has a central stripline copper trace (not shown), which electrically couples the radiating element 134 to the pin of the connector 136. The two layers of substrate 132 may be laminated with an adhesive, such as "Speedboard C" thermoset material marketed by W.L. Gore & Associates, Inc. Each outer face of the substrate 132 has a 1.27 mm (0.05") copper ground layer 133, which is tinned with solder (e.g., tin-lead solder). The exemplary clip 120 and radiating element have a 0.013 mm (0.0005") tin-lead plating (Sn63-Pb37) to provide the solder volume required to form a joint in a reflow operation and protect the joint from the environment.

This exemplary substrate material is only an example. One of ordinary skill can readily select an appropriate dielectric substrate material for any particular application.

As shown in FIG. 3, the strip 130 has a plurality of identical radiating elements 134 (horns). The horns 134 can be formed in the substrate 132 by any suitable circuit fabrication process, such as etching or machining the metal ground layers 133. Each radiating element 134 has a connector 136 for connecting the element to the transmit/receive distribution network (not shown). An exemplary connector is a Gilbert SK-1896-2 edge-launch male connector manufactured by the Corning Gilbert Corporation of Glendale, Ariz., which can be used to connect the center stripline circuit (between the two layers of substrate 132) directly to a coaxial cable. A resonating cavity and/or filter 139 is coupled between the connector 136 and the radiating element 134. Each radiating element 134 has a plurality of plated through holes 135 for matching. Additional plated through holes along the edge of the horns 134 form the sides of the horns, and are appropriately spaced for the frequency band of interest. Exemplary through holes may be 0.5 mm (0.02") in diameter. One of ordinary skill can select the size and spacing of the plated through holes for the operating frequency to be used.

The lower multi-element strip 130 has a plurality of slots 137, 138 with a respective slot between each pair of adjacent radiating elements 134. Each slot 137 (extending from the edge 132*a* proximate the ground plane 110) is sized and shaped so that the edges that define the slot fit within the slots 123 on two sides of a clip 120. The width of each slot 137 is sized to closely receive the core 127 of the clip 120. A connecting section (attachment portion) 132*c* lies above each slot 137 and below the corresponding distal slot 138. The connecting section 132*c* connects the portions of the substrate containing adjacent radiating elements 134. The connecting section (attachment portion) 132*c* is received by the slot 124 which penetrates the central axis of the clip 120, above the core 127. When the connecting strip 130 is in its final position, the connecting section 132*c* may optionally abut the top of the core 127, or a small space may be allowed between the connecting section and the core. The inside edges of slot 137 abut the sides of the core 127, and the front and rear faces of substrate 132 adjacent the slot 137 confront the side surfaces 123*s* of the slots 123. The lower strips 130 also have slots 138 located at an edge distal from the ground plane 110, to receive bridge portions 152*b* of the upper strips 150. In alternative embodiments (not shown) having more than two circuit boards intersecting at a clip, the slot 138 may receive connecting portions of two or more circuit boards (which may be accomplished by providing a longer slot 138, or shorter connecting portions on the upper circuit boards).

The bottom edge 132*a* of strip 130 abuts the ground plate 110 to locate the strip 130 for properly seating the connector 136 to mate with the distribution network (not shown), and may abut the top surface 122*t* of the base 122 of the clip 120. The front and rear faces of the connecting section 132*c* confront the two tabs 129 which extend upward from the core 127.

Optionally, each strip 130 can have one or more tabs 132*t*, 132*u* extending from the end thereof, to assist in the mechanical assembly of the array 100.

FIG. 4 shows an assembly step in which the lower multi-element strip 130 is in place relative to the clip 120, and the upper multi-element strip 150 is being moved into position. The upper multi-element strip 150 is similar to the lower multi-element strip, with significant differences explained below. Otherwise, like features of strip 150 have the reference numerals of corresponding features of strip 130, increased by 20. These like features include substrate 152, bottom edge 152*a*, metal layer 153, horns 154, plated through holes 155, connector 156, and resonating cavity/filter 159.

In strips 150, the configuration of the slots 157 and the bridge (attachment portion) 152*b* differ from that of the slots 137 of strips 130. The slot 157, extending from the bottom edge 152*a* proximate to the ground plane 110 is longer than the slot 137 of the lower strip 130 by an amount that is approximately the height of the connecting section 132*c* of the lower strip. The bridge (attachment portion) 152*b* is at or adjacent to the distal (top) edge of the strip 150 from the ground plane 110. There is no need for a second slot above the bridge 152*b*, and in preferred embodiments, there is none (although alternative embodiments—not shown—may optionally include a second slot, for example, to accommodate one or more additional circuit boards). The bridge 152*b* is received by the slot 138 of the strip 130.

Each slot 157 is sized and shaped to fit within the slots 123 on two sides of a clip 120. The width of each slot 157 is sized to closely receive the core 127 of the clip 120. The bridge section 152*b* is received by the slot 125 which penetrates the central axis of the clip 120, above the core 127 and above the connecting section 132*c* of the lower strip 130. Slots 138 and 157 intersect like a pair of intersecting combs. When the connecting strip 150 is in its final position, the bridge section 152*b* may optionally abut the top of connecting section 132*c*, or a small space may be allowed between them. The inside edges of slot 157 abut the sides of the core 127, and the front and rear faces of substrate 152 adjacent the slot 157 confront the side surfaces 123*s* of the slots 123. The bottom edge 152*a* of strip 150 abuts the top surface 122*t* of clip 120. The bottom edge of bridge section 152*b* may rest on the top edges of the two tabs 129, or alternatively, there may be a small space therebetween, depending on the configuration (so long as the connector 156 is properly seated for connecting to the distribution network). When assembled in this manner, the clip 120 positions and self-aligns the multi-element strips 130, 150 including the radiating elements 134, 154 in all axes to pre-established reference locations on the groundplane 110.

Figure 11:
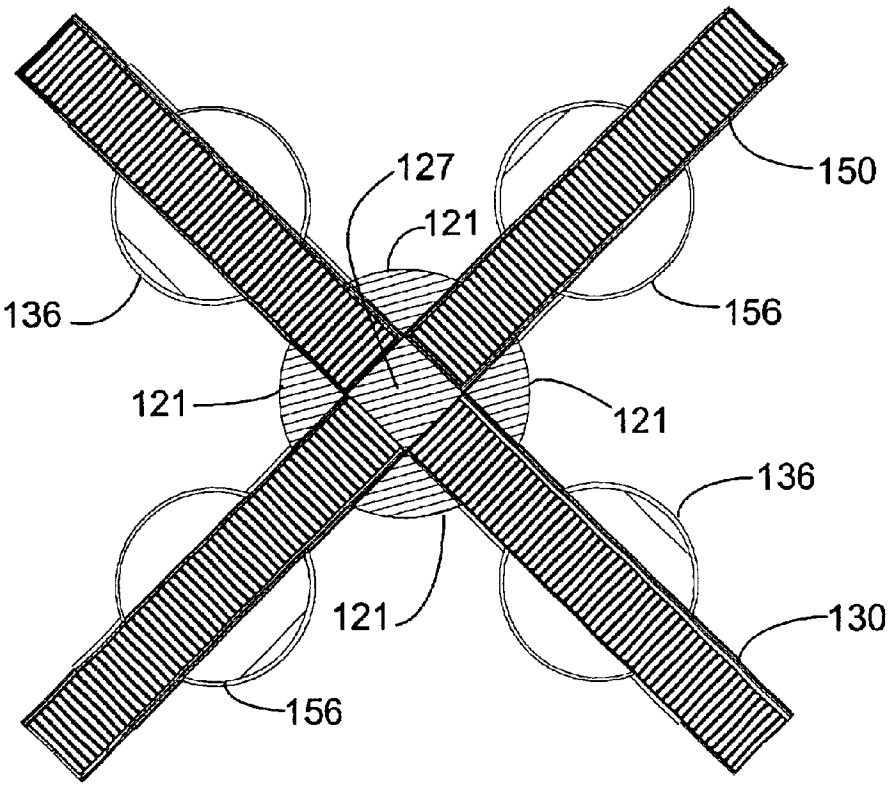
FIG. 11 is a cross sectional view of one clip and the multi-element strips connected thereto, taken along section line 11—11 of FIG. 5.

FIG. 5 shows the clip 120, lower strip 130 and upper strip 150 in the assembled configuration, with the joint ready for reflow soldering. In the example, the horns 134 and 154 are positioned at the same height, with the connectors 136 and 156 at the same height. The top edges of the substrates 132 and 152 and the top end 121*b* of the clip are all at the same height. The metal surfaces 133 and 153 immediately adjacent to the radiating elements 134, 154 are closely received within the slots of the clip 120, for forming an electrical connection. The core 127 is positioned between the adjacent radiating elements, to provide isolation and prevent leakage. The positioning of the core 127 with respect to the two multi-element strips 130, 150 is best seen in the cross sectional view of FIG. 11. The tapered portion 128 of the shaft 121 of clip 120 does not cross the edges of the horns 134, 154.

The clip 120 forms a junction or node between orthogonal element assemblies by allowing multi-element radiator strips 130, 150 to pass through its shaft 121 orthogonally as shown in FIGS. 3 and 4 forming the joint shown in FIG. 5 (Although the use of multi-radiator strips is recommended to best take advantage of the self-aligning features of the fastener, it is not required {i.e. individual radiating elements could be used}).

Although FIGS. 3–5 show a structure and method for assembling two perpendicular multi-element strips into an array of square cells, other embodiments may have circuit boards that are not perpendicular, e.g., to form a lattice of polygonal cells (e.g., diamond or hexagonal shaped cells).

Although the clip and strip arrangement of FIGS. 3–5 have only two strips intersecting at each clip, in other embodiments, three or more multi-element strips can intersect at a single clip.

Figure 6:
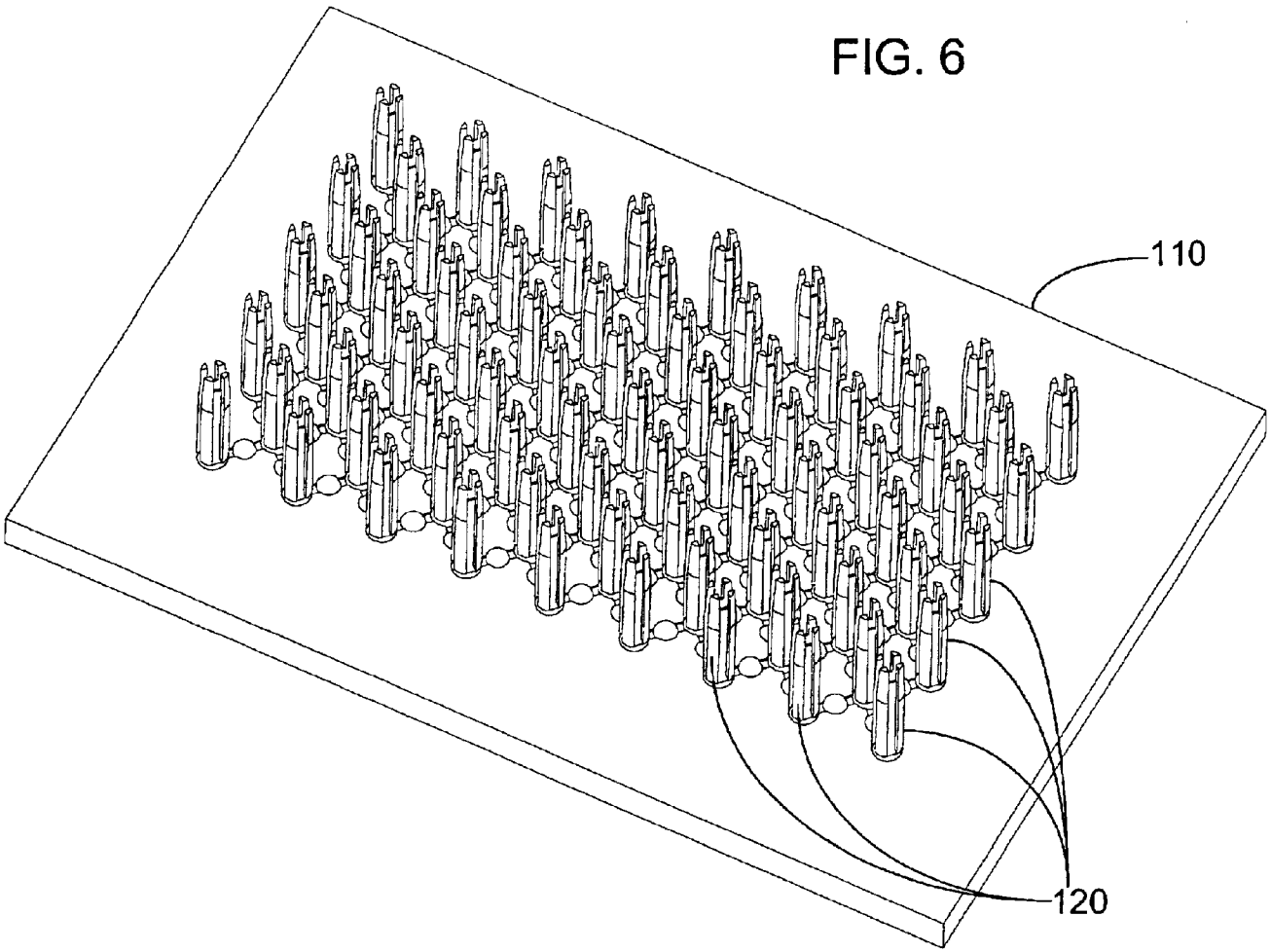
FIG. 6 shows a partial assembly including a plurality of clips (as shown in FIG. 2A) mounted to the ground plane shown in FIG. 1.
Figure 7:
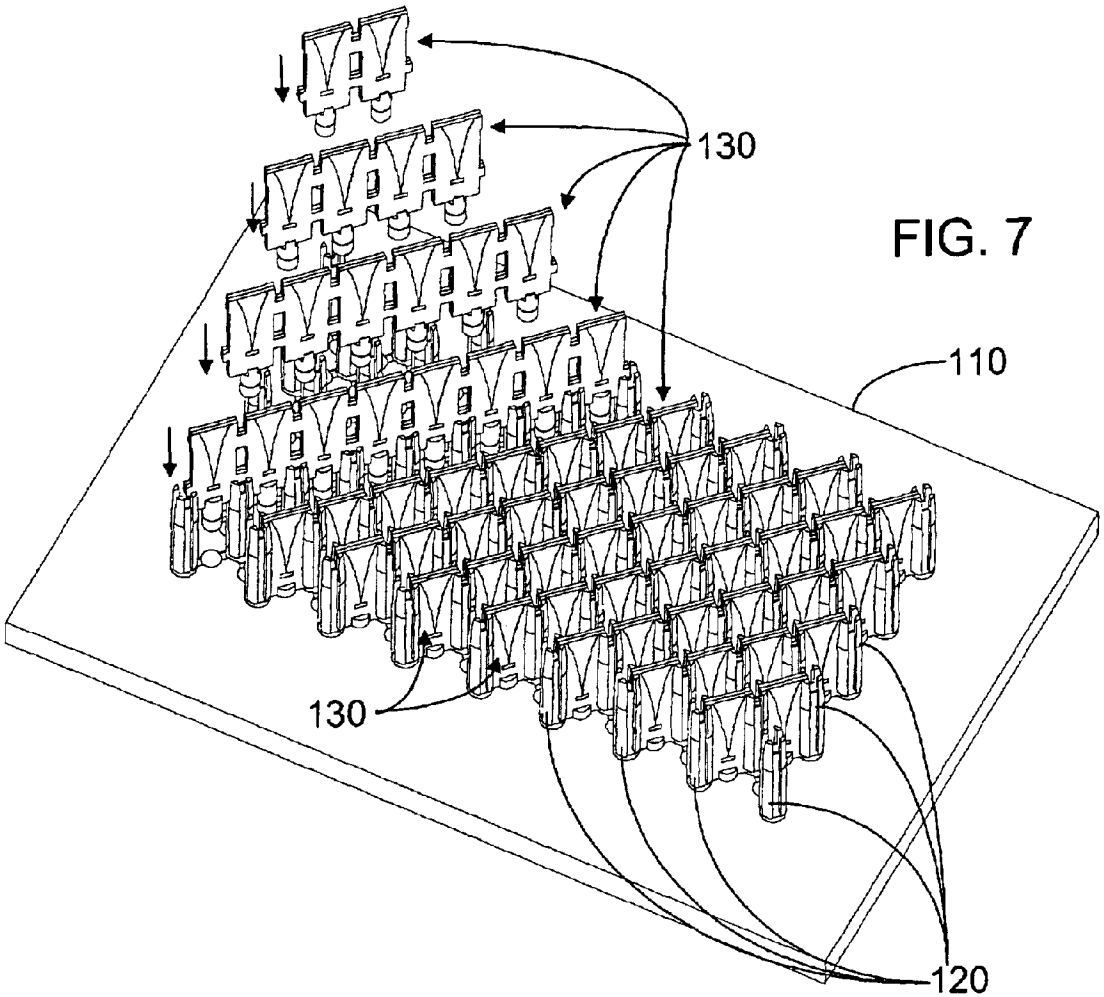
FIG. 7 shows the insertion of a plurality of lower multi-element strips into the partial assembly of FIG. 6.
Figure 8:
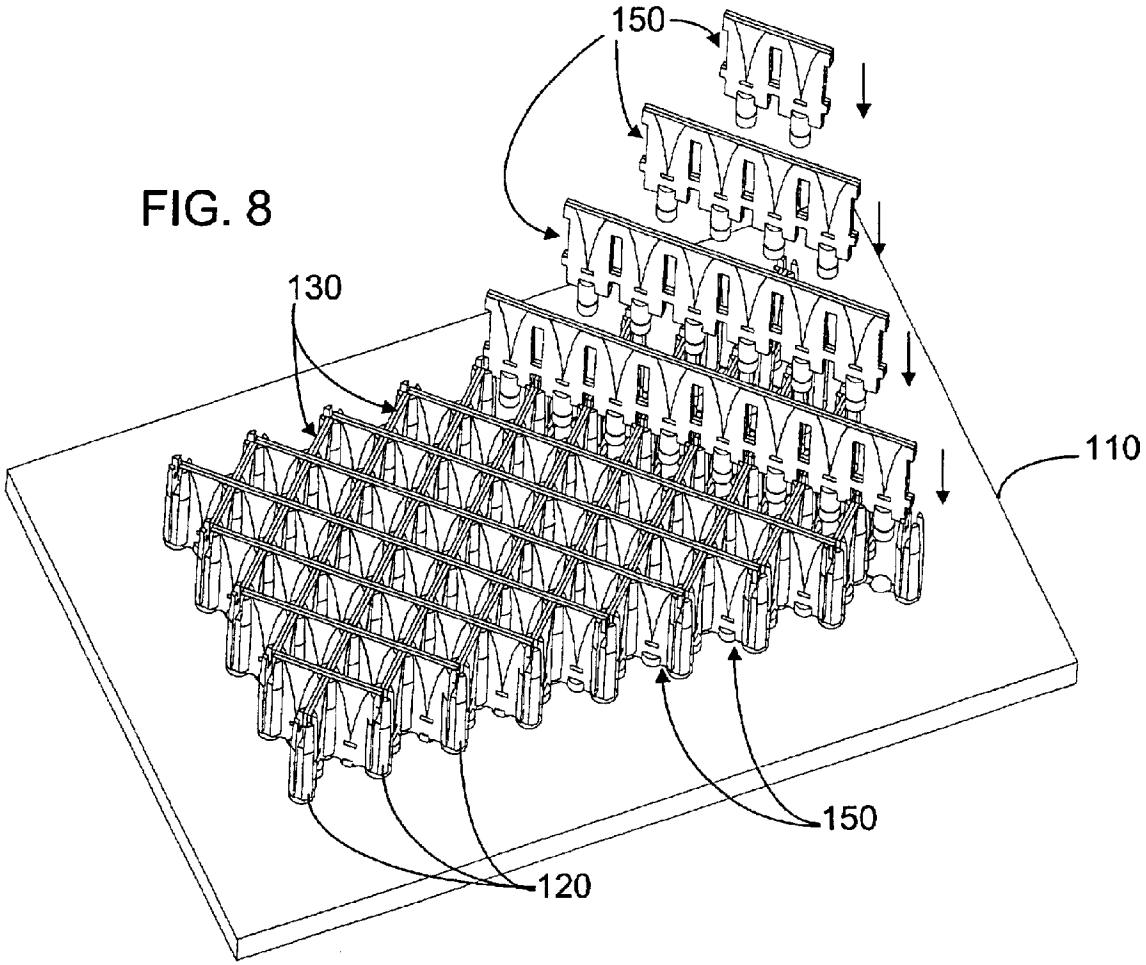
FIG. 8 shows the insertion of a plurality of upper multi-element strips into the partial assembly of FIG. 6.

FIG. 5 represents an individual joint, however, the design of clip 120 permits the entire aperture or a fractional portion thereof to be preassembled and soldered in one mass reflow process. This may be accomplished by assembling multiple fasteners (clips 120) into a groundplane 110 having any size as shown in FIG. 6. The multi-element strips 130, 150 containing a plurality of radiating elements are then assembled into the clip array, as shown in FIGS. 7 and 8. With an array of radiating elements 134, 154 joined together using the clip 120, the solder in assembly 100 is then reflowed en masse.

Figure 9:
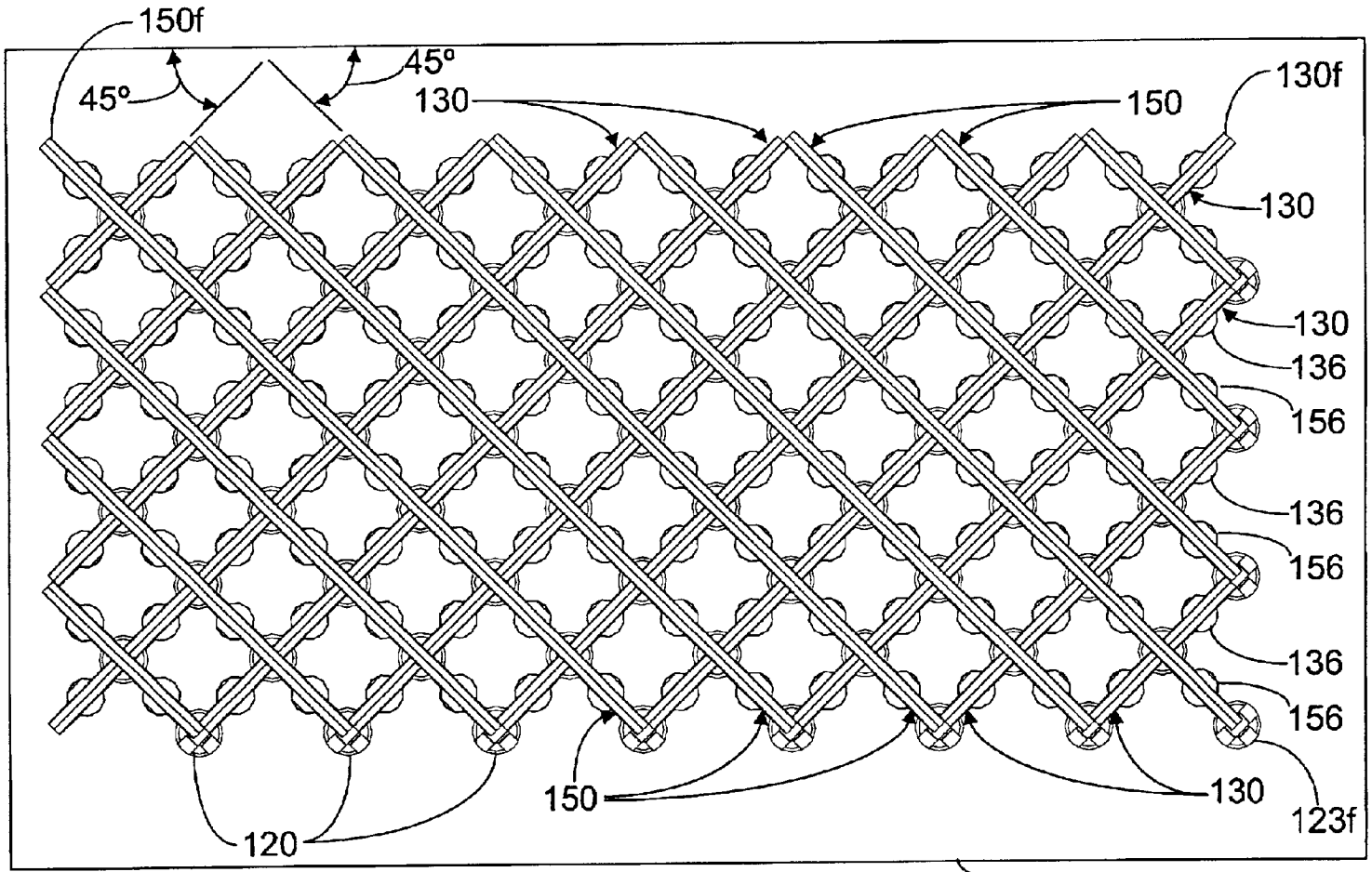
FIG. 9 is a top plan view of a fractional array assembly.

FIGS. 6–9 show an exemplary method of assembling the array shown in FIG. 1, or a fractional array assembly shown in FIG. 9. The difference between the array 100 of FIG. 1 and the fractional array assembly 101 of FIG. 9 is that in the fractional array assembly 101, clips are omitted on one or two sides of the assembly 101, to allow the assembly to be interfaced to the clips of another similar fractional array assembly in a larger array 200 (shown and discussed burther below with reference to FIG. 13). Otherwise, the configurations are the same.

Figure 13:
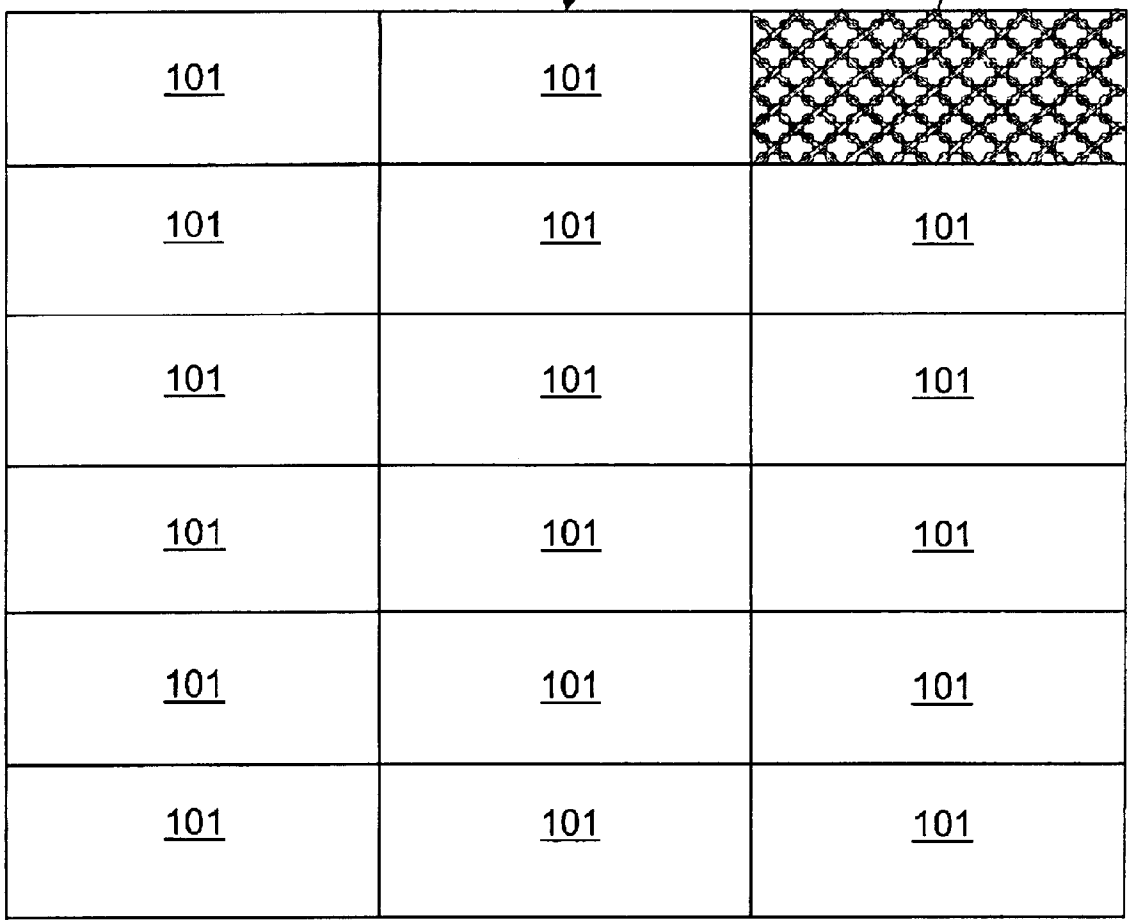
FIG. 13 shows an array comprising a plurality of fractional array assemblies of the type shown in FIG. 9.

The configuration of FIGS. 6–9 is referred to herein as a triangular lattice with a rectangular form factor. Successive rows of clips 120 are interlaced, and the slots 123 are oriented at ±45 degrees from the vertical edge of the array, and ±45 degrees from the horizontal edge of the array. As a result, as best seen in FIG. 9, the radiating elements are oriented at ±45 degree angles from horizontal. In FIG. 9, four different substrate lengths (corresponding to two, four, six and eight radiating elements, respectively) are sufficient to form a 64 element fractional array 101 having a rectangular form factor. The number of different substrate lengths used for any given fractional array 101 depends on the lesser of the number of rows and the number of columns of elements. An array 200 having a desired number of elements can be formed using a plurality of such fractional arrays 101. For example, as shown in FIG. 13, an 1152 element array 200 can be formed of 18 fractional array sections 101. The fractional array assemblies 101 can be installed and secured from the rear with fasteners (e.g., screws) in the clips 120. The junctions between sections may be epoxied or soldered.

FIG. 6 shows a plurality of clips 120 positioned on a ground plane 110, prior to installation of the printed circuit boards. The clips 120 may be fastened to the ground plane 110 from the rear surface (not shown) using conventional hardware.

FIG. 7 shows a plurality of first (lower) strips 130 being inserted on a first subset of the clips 120, with the strips 130 parallel to each other. The connectors 136 are pre-attached to the multi-element strips 130, for example, using a conventional technique. The first (lower) strips 130 have a plurality of radiating elements 134 and a first plurality of slots 138. As shown in FIG. 7, the first strips 130 may have respectively different lengths, so as to provide the array 100 or fractional array 101 with any desired shape (e.g., rectangular, square or approximately octagonal or circular), with a respective one of the plurality of clips at each corner of each polygonal cell.

FIG. 8 shows a plurality of second (upper) strips 150 being inserted on the first strips 130 and a second subset of the clips 120, with the strips 150 parallel to each other, and normal to the first strips 130. The intersecting lower and upper strips 130, 150 form an array of square cells, with respective horns 134, 154 within each of the cells. The second (upper) strips 150 have a plurality of radiating elements 154 and a first plurality of slots 157. As shown in FIG. 8, the second strips 150 may also have respectively different lengths, so as to provide the array 100 or fractional array 101 with any desired shape (e.g., rectangular, square or approximately octagonal or circular).

FIG. 9 is a plan view of the assembled fractional array 101, which is preferably heated to reflow the solder at each connection between one of the clips 120 and one of the multi-element strips 130, 150.

FIG. 10 is an enlarged detail of FIG. 1, showing a pair of adjacent cells in detail. A conductive joint 160 (e.g., solder) is formed at clip 120 along each edge of the slots 137, 157 of the first and second multi-element strips 130, 150. The clips 120 form structural nodes in the reflowed array 100 or fractional array assembly 101 as shown in FIG. 10 which makes the "eggcrate" structure very rigid.

When considering a 5000 element (10000 radiating element) dual polarized phased array and using the clip 120 in this manner, 5000 solder joints can be formed at once in a reflow operation. FIG. 10 also shows the excellent conduction path to the groundplane through the clip 120.

Another feature of the triangular lattice with the rectangular form factor in FIG. 9 is that the clip 120 in each corner of the lattice connects to a multi-element strip 130 or 150 aligned in one, but not both directions. Thus, the first strips 130 attach to a first subset of the clips 120, while the second strips 150 attach to a second subset of the clips.

In addition, for an exemplary rectangular fractional array assembly 101 of FIG. 9, the ends 130*f*, 150*f* of the strips 130, 150 on two adjacent sides (e.g., top and left, as shown in FIG. 9) of the assembly 101 are free, and are not attached to clips 120. The ends of the strips 130, 150 on the two remaining sides (e.g., bottom and right, as shown in FIG. 9) of the assembly 101 have clips 120 with two open slots 123*f*. When a plurality of fractional arrays 101 are joined together as shown in FIG. 13, all of the fractional arrays are oriented the same way, so that the free strip ends 130*f*, 150*f* of one assembly 101 can be attached to open slots 123*f* of the adjacent fractional array. In the case of a fractional array 101 that has one or more sides on the perimeter of the full array 200, the sides of the fractional arrays 101 that lie along the perimeter of the full array 200 preferably have all of their strip ends provided with clips 120. That is, it is preferable that the completely assembled full array 200 does not have strips 130, 150 with free ends 130*f*, 150*f*.

Figure 14:
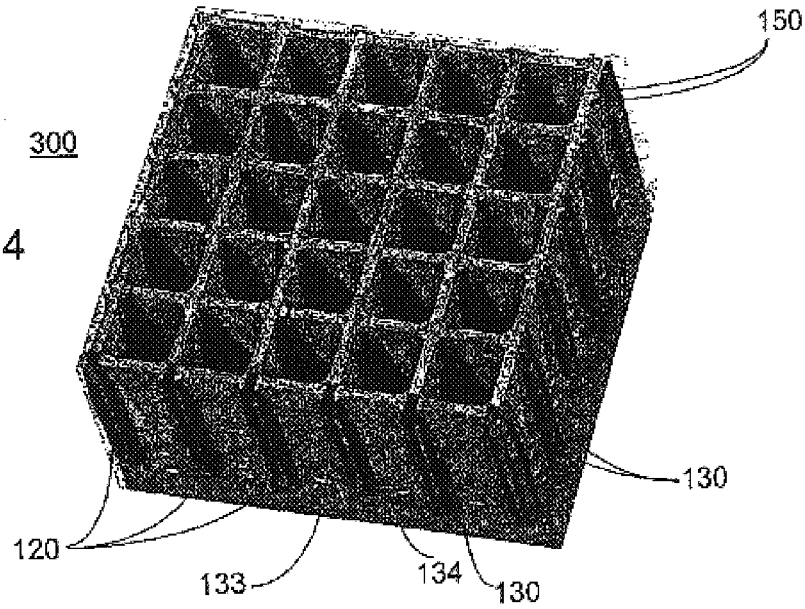
FIG. 14 is an isometric view of a variation of the fractional array shown in FIG. 1.

FIG. 14 shows another arrangement of the clips 120, lower strips 130 and upper strips 150. Although the embodiment shown in FIGS. 1–11 includes a triangular lattice pattern with interlaced rows of clips 120, other configurations are contemplated. For example, in alternative embodiments such as that of FIG. 14, the rows and columns of clips 120 are all aligned in a plain rectangular grid 300, which may be square. The lower multi-element strips 130 are aligned with rows of clips 120, and the upper multi-element strips 150 are aligned with columns of clips 120. In this configuration, each lower multi-element strip 130 has the same first number of radiating elements, and each upper multi-element strip 150 has the same second number of radiating elements, where the first and second numbers may be the same as, or different from, each other.

In the examples of FIGS. 1–11 and 14, each collinear arrangement of radiating elements is provided using a single multi-element strip 130 or 150. In other embodiments (not shown), a relatively long collinear arrangement of radiating elements may be provided using two or more aligned multi-element strips, where the abutting ends of each strip comprise a respective half of the slots 37, 38 (for lower strip 130) or 57 (for upper strip 150). A clip 120 of the same type shown in FIGS. 2A–2E can receive the ends in the same manner described above. This technique may be used to reduce the number of different multi-element strip sizes in an array having a large number of rows and a large number of columns of radiating elements. This is similar to the technique used in FIG. 13, at the boundary between adjacent fractional array assemblies 101.

Figure 12:
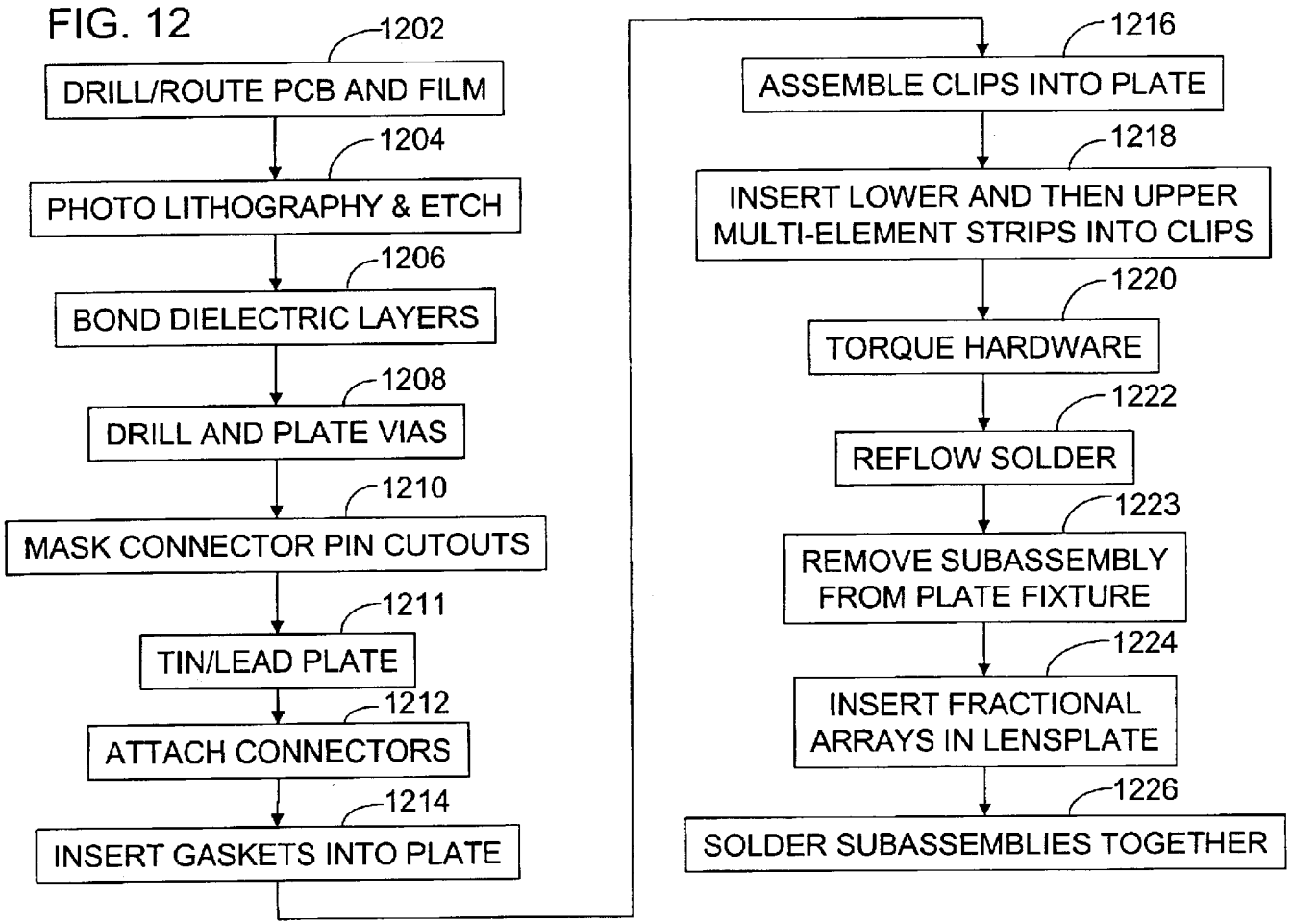
FIG. 12 is a flow chart diagram showing a method of assembling an array or fractional array assembly.

FIG. 12 is a flow chart diagram of a method for fabricating an array 200 or fractional array assembly 101.

At step 1202, the printed circuit boards (PCBs) 132 and 152 and any bonding film used to laminate the PCBs are drilled and/or routed. For example, if the first Duroid board has the stripline circuit, a channel is routed into the second Duroid board to accommodate the coax connector pin that contacts the end of the stripline circuit and connects to the edge launch connector 136.

At step 1204, photo lithographic processes are preformed to form the stripline center conductor between the two circuit boards for each multi-element strip.

At step 1206, the pair of dielectric layers for each multi-element strip 130, 150 are bonded together, for example, using a thermosetting adhesive.

At step 1208, the vias 135, 155 in each multi-element strip 130, 150 are drilled and plated.

At step 1210, connector pin cutouts are masked to prevent the cutouts from filling with the tin-lead solder.

At step 1211, the tin/lead (or other solder or indium) is applied to the copper ground planes 133, 153 and the edges of the multi-element strips 130, 150. The inside edges of the slots 137, 138, 157 may also be plated.

At step 1212, the connectors 136 are attached to each of the central stripline circuits (not shown).

At step 1214, a gasket (not shown) may be inserted into each clip-receiving hole in the plate 10. The gasket is positioned so that, in the finished assembly, the gasket lies beneath the base 122 of each clip 120. The gasket can provide EMI shielding, a weather seal for the marine environment, and a light pressure seal. The gasket may be, for example, a Cho-Seal 1298 corrosion resistant EMI gasket manufactured by Parker Chomerics of Woburn, Mass. A gasket may also be positioned in the hole through which the connectors 136, 156 extends.

At step 1216, the clips 120 are loosely assembled onto the ground plate 110 or an assembly fixture plate. The clips 120 are not tightened until after the substrates 132, 152 are in place on the clips, which assures the rotational alignment of the clips. The plate and clip configuration is shown in FIG. 6. In alternative embodiments (not shown) the base 122 of the clip 120, or the hole into which the base fits, may be keyed to rotationally align the clip.

At step 1218, first the lower strips 130 are inserted (FIG. 7) and pressed into position on the corresponding clips 120, and then the upper strips 150 are pressed into position on the corresponding clips 120 and lower strips 130 (FIG. 8).

At step 1220, the hardware (e.g., screws and washers on the bottom surface of the ground plane 110) holding the clips 120 to the plate 110 are tightened, to maintain each substrate in position during further processing.

At step 1222, the solder at the clip/circuit board interfaces are reflowed to form an electrical and mechanical connection. In some embodiments, the entire fractional array 101 is placed in a reflow oven (not shown) for this purpose. In other embodiments, a local heating tool is used to reflow the solder locally only at the boundaries.

In some embodiments, a reflow tool (not shown) applies radiant heat at the locations of the clips 120. An example of a reflow tool includes a plurality of heating elements, each including a cartridge heater at the center of a ceramic insulator. The insulators may have cutouts to direct the radiated heat. These heating elements may be configured in a one or two dimensional array.

At step 1223, the fractional arrays 101 are removed from the assembly plate fixture.

At step 1224, the fractional arrays 101 are inserted into the lensplate for the whole array.

At step 1226, the solder at the boundaries between adjacent fractional array subassemblies 101 is reflowed, to form solder joints 160 between the fractional arrays. In some embodiments, the entire array 200 is placed in a reflow oven (not shown) for this purpose. In other embodiments, a local heating tool is used to reflow the solder locally only at the boundaries. An L-shaped configuration of heating elements may be advantageous for reflowing solder at boundaries between rectangular fractional array subassemblies 101.

The clip facilitates the use of a reflow process that can assembly very large arrays of radiating elements. A reflow process of this type is advantageous for high frequency-wide band radiating elements where a small lattice—for example <1.0 cm (<0.400") center to center at 16 GHz—limits the working space when using local soldering or epoxy attachments that require alignment tooling.

Some advantages of the attachment method described above are that the clip 120 eliminates the need for alignment tooling to position the radiating elements vertically, laterally, or rotationally. The clip 120 can absorb the dimensional instability and tolerances of soft-substrate radiating elements. It provides excellent element-to-element isolation and grounding. The optional tapered base 122 minimizes positional variation during the assembly process.

In the assembly method described above, the clips 120 are first installed on a plate or fixture (FIG. 6) and then the radiating-element strips 130 and 150 are installed (FIGS. 7 and 8). In other embodiments, each lower radiating element strip 130 is assembled to a row of clips on an accurately machined faceplate fixture. The individual strip 130 and attached clips are soldered locally or in a reflow oven, or joined with conductive epoxy. The strip 130 with attached clips 120 are then removed from the fixture and placed in the two-dimensional plate 110. At the completion of this step, the configuration is similar to that at the end of the insertion step shown in FIG. 7, except that the individual lower radiating element strips 130 are already soldered to the clips 120. This method adds an additional solder reflow step.

In other embodiments, instead of fabricating fractional arrays 101 and assembling the fractional arrays into an array 200, all of the strips 130, 150 may be installed on the array lensplate, and the solder for the full array 200 can be reflowed at once, either in a large oven, or by passing a heating element (or plurality of heating elements) over the full array.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A radar assembly, comprising:

a ground plane;

a plurality of clips inserted into the ground plane;

at least one first strip on a first subset of the clips, the first strip having a plurality of radiating elements and a first plurality of slots; and at least one second strip on a second subset of the clips and on the at least one first strip, the second strip having a plurality of radiating elements and a second plurality of slots that mate with the slots of the at least one first strip.

2. The radar assembly of claim 1, wherein each of the first subset of clips has a plurality of grooves, and portions of the at least one first strip are shaped to slide into respective grooves of the first subset of the clips.

3. The radar assembly of claim 1, wherein each of the second subset of clips has a plurality of grooves, and portions of the at least one second strip are shaped to slide into respective grooves of the second subset of the clips.

4. The radar assembly of claim 1, wherein:

the at least one first strip has respective attachment portions adjacent to each of the first plurality of slots, the first subset of the clips have receiving slots at distal ends thereof, and the attachment portions of the at least one first strip are inserted into respective receiving slots of the first subset of the clips.

5. The radar assembly of claim 1, wherein:

the at least one second strip has respective attachment portions distal from the ground plane, the second subset of the clips have receiving slots at distal ends thereof, and the attachment portions of the at least one second strip are inserted into respective receiving slots of the second subset of the clips.

6. The radar assembly of claim 1, wherein the at least one first strip is aligned and positioned with respect to the first subset of the clips.

7. The radar assembly of claim 1, wherein the at least one second strip is aligned and positioned with respect to the second subset of the clips.

8. The radar assembly of claim 1, wherein the clips each have a solid metal core that provides isolation between adjacent ones of the radiating elements of the first and second strips.

9. The radar assembly of claim 1, wherein surfaces of the first and second strips that are to be adjacent to the clips are tinned with a metal.

10. The radar assembly of claim 9, wherein the metal is one of the group consisting of solder and indium.

11. The radar assembly of claim 1, further comprising conductive joints between each of the first and second strips and the first and second subset of the clips, respectively.

12. The radar assembly of claim 11, wherein the conductive joints are solder joints.

13. The radar assembly of claim 1, wherein the first plurality of slots of the at least one first strip are located at an edge distal from the ground plane, and the second plurality of slots of the at least one second strip are located at an edge proximate to the ground plane.

14. The radar assembly of claim 13, wherein the at least one first strip has a third plurality of slots proximate to the ground plane, the third plurality of slots being shaped to slide over the first subset of the clips.

15. The radar assembly of claim 13, wherein the second plurality of slots are shaped to slide over the second subset of the clips.

16. The radar assembly of claim 1, wherein the at least one first strip includes a plurality of first strips, and the at least one second strip includes a plurality of second strips.

17. The radar assembly of claim 16, wherein the fist and second strips form a lattice having a plurality of polygonal cells with a respective one of the plurality of clips at each corner of each polygonal cell.

18. The radar assembly of claim 17, wherein each cell of the lattice has a shape from the group consisting of a square and a diamond.

* * * * *